United States Patent [19]

Watkins

[11] 4,030,472

[45] June 21, 1977

[54] AERIAL TOY AND LAUNCHING STICK APPARATUS

[76] Inventor: Michael L. Watkins, 12542 Euclid St., Garden Grove, Calif. 92640

[22] Filed: June 16, 1976

[21] Appl. No.: 696,493

[52] U.S. Cl. ..... 124/5; 46/74 R; 124/42

[51] Int. Cl.[2] ..... F31B 3/04

[58] Field of Search ..... 46/74 R, 60, 85; 124/5, 124/42

[56] References Cited

UNITED STATES PATENTS 3,797,372 3/1974 Knisely ..... 124/5

FOREIGN PATENTS OR APPLICATIONS 16,216 10/1891 United Kingdom ..... 46/85

*Primary Examiner*—Louis G. Mancene
*Assistant Examiner*—Robert F. Cutting
*Attorney, Agent, or Firm*—Gary Appel

[57] ABSTRACT

An aerial toy and launching stick apparatus comprises an elongate tubular stick having a helical track or guide formed about the periphery of at least major portions thereof. One end of the stick is expanded outwardly a small amount to form a stop. A sliding member has inner dimensions permitting slipping along the tracked portion of the stick but preventing movement past the stop and has a track follower on an inner surface so that the member is caused to rotate as it is slid along the stick. A spaced pair of thin flexible flanges are formed on the sliding member to receive and releasably retain a hub portion of the aerial toy before launching. The toy is otherwise in the form of a circular disc of relatively large diameter and is preferably constructed having outer edges curved downwardly and under to impart a generally air-foil section to the toy. Operation is by grasping an end of the stick remote from the stop and quickly whipping or snapping the stick in the direction it is desired to sail the toy with the toy initially near the gripping hand. This whipping causes both the sliding member and toy to slide and rotate along the stick until the member reaches the stop and is stopped. Momentum of the aerial toy, causes its release from the sliding member, and the toy bypasses the stop to soar in the launch direction.

9 Claims, 4 Drawing Figures

AERIAL TOY AND LAUNCHING STICK APPARATUS

BACKGROUND OF THE INVENTION

1. Field of the Invention

The present invention relates to the field of aerial toys, and more particularly to such toys in combination with launching sticks therefor.

2. Discussion of the Prior Art

Various types of so called aerial toys, which usually include a propeller-shaped toy launched into the air from a stick having a helical track formed therealong, have previously been disclosed. As the toy to be launched is moved along the stick the helical track imparts a spinning motion to the toy, causing it to attain added height after launching. Typical of such previous disclosures are those of Cressler, Voellmecke and Kowalski (U.S. Pat. Nos. 651,698; 1,843,636 and 2,969,609) and the foreign patent of Roffler (Swisa Pat. No. 256,255).

Most of the previously disclosed and available aerial toys of this type include a slider which slips along the stick, and which has an outer end surface upon which the toy rests before launching. Typically, a user grips one end of the stick and with his other hand rapidly slides the slider, and hence also the toy be launched, outwardly towards the free end of the stick, thereby imparting both outward and spinning motions to the toy. At the end of the user's arm reach, the still gripped slider stops; whereas, momentum previously attained causes the toy to be launched into the air, the height achieved depending to a large extent upon both the shape of the toy and the rapidity of its launching by the user.

In one particular disclosure (Coe, U.S. Pat. No, 465,162) a stop is provided at the outer end of the stick to prevent launching of the spinning toy, and constrains it to spin around a smooth, non-tracked end region of the stick like a top. This spinning motion is, however, imparted to the toy by a slider in the above described manner.

All of these and similar disclosures and apparatus are, however, deficient in the manner of launching or spinning the aerial toy. Since the slider is operated with one hand while gripping the stick with the other, sliding of the slider requires a relatively awkward movement and the length of sliding movement is restricted to the user's arm reach. Young children or those children with coordination problems are consequently often unable to achieve satisfactory heights or spinning of the toys. And if the stick is substantially longer than the user's arm reach, frictional drag of the stick on the toy before launching or free spinning slows the toy a great amount.

A further disadvantage with such apparatus for launching an aerial toy is that the toy can be launched only in a direction generally along the axis of the stick, as it is very difficult to apply any sideways or translateral motion due to the manner of launching. Since the toy is usually launched vertically it merely goes up and then comes straight back down, unless there is a wind to carry it. Thus interest in the toy is soon lost.

Heretofore, to applicant's knowledge, there have been disclosed or available no aerial toys which can be launched in a more efficient manner and to which can be imparted, at launch, a substantial sideways component of velocity which permits the toy to be launched towards a distant target or player.

SUMMARY OF THE INVENTION

An aerial toy and launching stick apparatus comprises an elongate toy launching stick having a gripping end and an opposite toy launching end, the stick being formed with at least major portions adjacent to the launching end having a generally uniform cross section with a helical guide formed about the periphery thereof. A stop, fixed to the launching end of the stick, has portions which extend radially outwardly beyond adjacent surfaces of the stick. A sliding member of tubular configuration has inner dimensions permitting the member to slide along those portions of the stick having the guide but preventing the member from sliding past the stop. The sliding member includes guide means on inner regions thereof for causing the member to follow the guide and thereby rotate about the stick as the member is slid along those portions having the guide.

The apparatus includes an aerial toy which has a central aperture for fitting over portions of the slide member, the aperture being larger than the stop to permit the toy to be launched off the stick over the stop. Mounting means are provided for releasably mounting the toy to the sliding member so that the toy is constrained to move and rotate in unison with the member as the member is slid along the stick, yet permitting releasing of the toy from the member when the member is abruptly stopped by the stop.

More specifically, the sliding member is formed in a spool-like shape having thin elastomeric upper and lower flanges between which a hub portion of the toy is confined prior to launching of the toy. The lower flange may be flexed aside to install the toy onto the sliding member and the upper (outer) flange flexes aside to permit the toy to continue movement after the sliding member hits the stop. The toy is preferably configured in the form of a flat disc having downwardly and inwardly curved edge regions, giving to the toy a generally air foil-like cross section which enhances its soaring characteristics.

To launch the toy, a user grasps the stick by the gripping end with the sliding member and toy near that end of the stick, the user sharply snaps or whips the stick in the desired toy launching direction. The sliding member and toy are thereby caused to slide rapidly outwardly along the stick until the sliding member hits the stop and is abruptly stopped. Momentum, however, causes the toy to be released from the sliding member and be launched over the stop and into the air.

Because the sliding member is not required to be slid manually along the stick, it can be slid faster by centrifugal action as the stick is whipped and can be moved farther than the user's arm reach. The toy is launched both outwardly and in the direction the stick is whipped enabling the toy to be launched at a distant target or player.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENT

Figure 1:
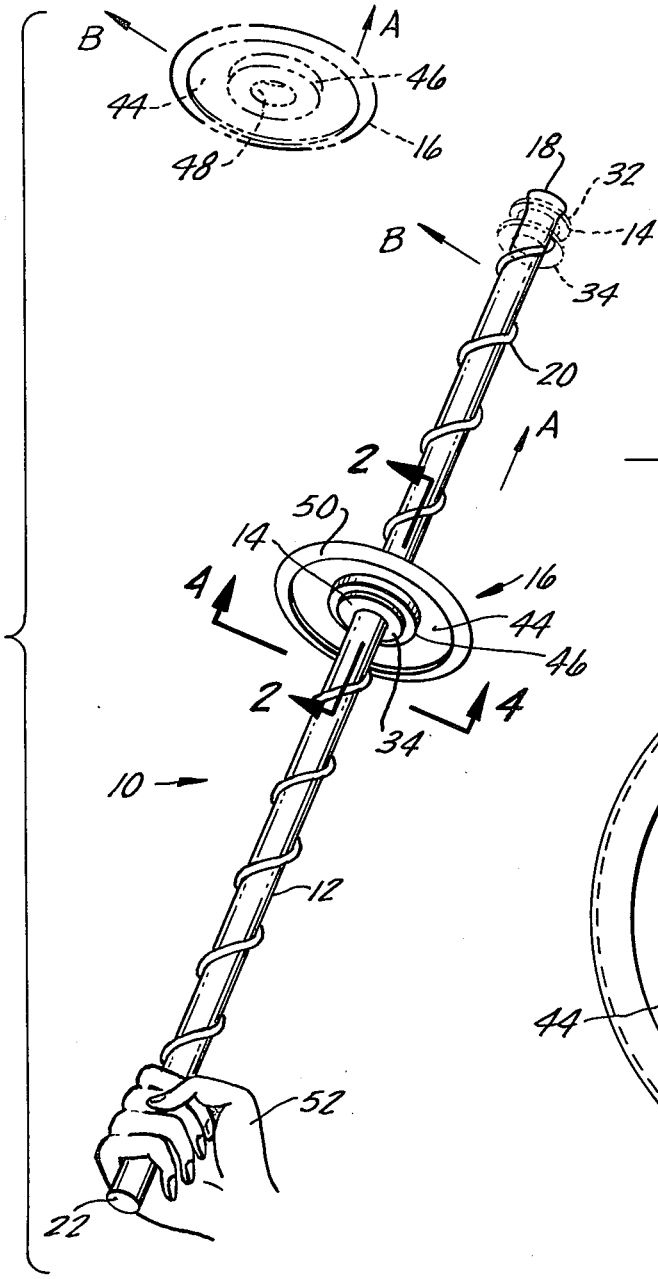
FIG. 1 is a perspective view showing the aerial toy and launching apparatus and showing a launched toy in phantom lines.

As best seen in FIG. 1, an aerial toy and launching apparatus 10 comprises generally an elongate, rigid launching element on sticks 12, a slider or sliding member 14 operative for sliding along the stick and an aerial toy 16.

The stick 12, which may be tubular in form for strength with low weight and which may be 3 or 4 feet long, is formed having a stop 18 at an outermost end. Preferably, the stop 18 is formed by flairing or expanding an end portion of the stick 12 outwardly so that outer dimensions of the stop are substantially larger than outer dimensions of adjacent portions of the stick. Alternatively, the stop 18 may be separately constructed and then fixed to the end of the stick 12. For example, the stop 12 may thus alternatively comprise an elongate pin inserted transversely through an end portion of the stick to project beyond opposite sides thereof.

Formed around the outer surface of periphery of the stick 12 is a helical track or guide 20 which extends axially along at least major portions of the stick adjacent to the stop 18. The guide 20 is preferably formed by wrapping and fixing a long slender bar or rod helically about the stick 12 to form an outwardly projecting flange. Alternatively, the guide 20 may be formed by cutting or molding a helical groove around and along the stick 12.

The "pitch" of the track 20 is such that several turns or coils are made about those portions of the stick 12 on which the track is formed. A handle end 22 of the stick 12 is preferably formed, for ease and comfort in gripping the stick, untracked. However, this is not necessarily the case, particularly if, for ease in construction, the stick 12 is to be cut from a much longer stick.

Figure 3:
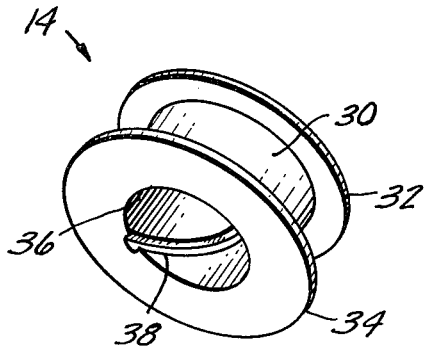
FIG. 3 is a perspective view of the sliding member showing inner track follower portions.
Figure 2:
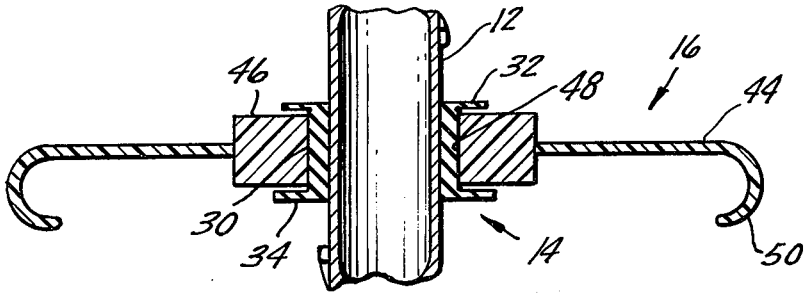
FIG. 2 is a sectional view along line 2—2 of FIG. 1, showing features of a sliding member and the aerial toy.

Formed to receive the aerial toy 16, the sliding member 14 is constructed in spool-like shape, and having a comparatively short tubular central portion 30 from which mutually spaced upper and lower arcular flanges 32 and 34, respectively, project in a radial direction (FIGS. 2 and 3). Both of such flanges 32 are 34 are relatively thin and narrow, and are made of a pliable or elastomeric material, such as a soft plastic or rubber, which permits them to be deflected aside relatively easily both to receive the toy 16 onto and release the toy from the central portion 30 between the two flanges. It is to be appreciated, however, that the flanges 32 and 34 neither need to be circular in shape nor continuous, their function being to releasably confine the toy 16 to the member 14 prior to launching of the toy. The central portion 30 is formed so that innermost regions of the upper flange 32 are outwardly of outermost regions of the stop 18 so that flexing of the flange to release the toy 16 is not inhibited or prevented.

A helical recess or track follower 36 is formed around an inner surface 38 of the central portion 30 of the member 14 to engage the track 20 formed on the stick (FIG. 3), assuming that the track projects outwardly therefrom. If, however, the track 20 is formed as a groove around and along the stick 12, the track follower 36 then comprises a projecting portion for fitting into the grooved track. By means of the track follower 36, as the member 14 is slid along the tracked portion of the stick 12, a turning or spinning motion is imparted to the member, since it is constrained to follow the track 20.

Figure 4:
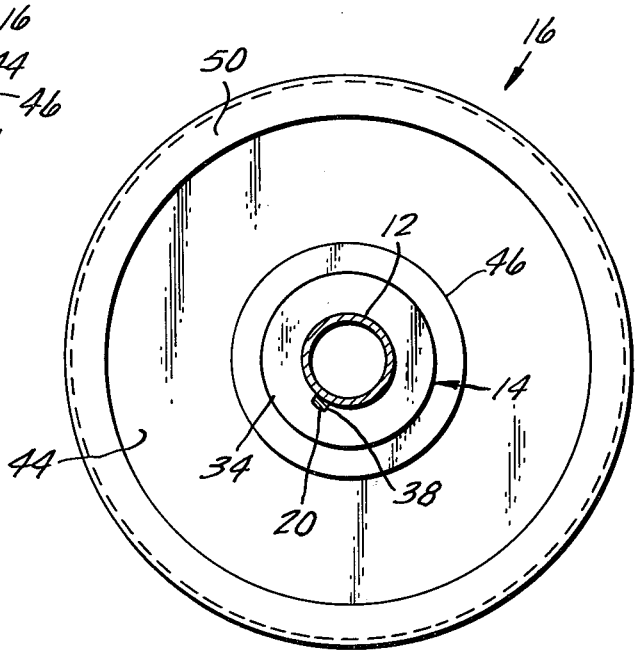
FIG. 4 is a sectional view along line 4—4 of FIG. 1, showing features of the sliding member and the aerial toy.

The aerial toy 16 includes a comparatively large diameter disc or soaring portion 44 and a central hub portion 46 (FIGS. 2 and 4). Thickness of the hub portion 46 is preferably about the same as the sliding member flanges 32 and 34. An inner aperture 48 formed in the hub portion 46 is slightly larger than the outer diameter of the sliding member central portion 30 and is thus larger than outer dimensions of the stop 18, thus permitting the toy 16 to be launched from the stick 12 without interference. The hub portion 46 is constructed, relative to the sliding member 14, to slide onto the central portion 30 by deflecting aside one of the flanges 32 or 34 and to be launched from the member by deflecting aside the upper (outer) flange 32. Preferably, the hub portion 46 fits relatively tightly over the sliding member 14 and thus it and the entire toy 16 are constrained to rotate about the stick 12 in unison with the member as the member is slid along the stick. This imparts a spinning motion to the toy 16 as it is launched, thereby increasing the sailing distance and imparting stability to the toy as it sails through the air. Also the width or thickness of the hub portion 46 in the region of the aperture 48 is sufficient to maintain the toy generally orthogonal to the member 14.

In cross section, the aerial toy soaring portion 44, which is fixed to the periphery of the hub portion, for example, as an extended molded portion thereof, may be generally air foil-like, having outer peripheral regions 50 curved downwardly and under. Such a cross section enhances the soaring characteristics of the toy 16. Alternatively, however, the soaring portion 44 may be formed as a substantially flat disc or other flat shape or be formed into propeller-like shape with the propeller blades flat or twisted slightly in the manner of an airplane propeller.

It is to be appreciated that other means may alternatively be employed for temporarily, until launching, securing an aerial toy (corresponding to the toy 16) to a sliding member (corresponding to the member 14). Instead of the sliding member flanges 32 and 34, the central portion 30 and inner surfaces of the hub aperture 48 may be formed with one or more detents and corresponding detent recesses, or the central portion 30 may have a peripheral groove into which a flexible, inwardly directed flange formed from the hub aperture 48 fits. The principal requirement is that the toy 16 be fixed (preferably non-rotatably fixed) to the sliding member 14. As a user gripping the handle end 22 of the stick 12 by one hand 52 (FIG. 1) with the sliding member 14 and toy 16 near the hand, flips or whips the stick in a manner causing the sliding member 14 to slide rapidly along the stick from the handle end towards the stop 18, (arrow A, FIG. 1), a longitudinal as well as a spinning movement is imparted to both the sliding member and the aerial toy. When the sliding member 14 reaches the stop 18, it is abruptly stopped, but the momentum achieved by the toy 16 causes disengagement of the toy from the sliding member 14 and causes the toy to soar generally in the direction the stick has been whipped (Arrows B, FIG. 1), and also outwardly (in the direction of arrow A). A launched toy 16 is shown in phantom lines in FIG. 1.

According to this method of operating, only one hand is required. The sliding member 14 is not manually slid along the stick 12, but is rather forced outwardly along the stick by centrifugal forces caused by whipping the stick. Thus the stick 12 may be made relatively long, since operation of the sliding member 14 is not limited by a user's arm reach.

In addition, by rapidly whipping the stick 12, the toy 16 can be given a relatively high velocity in the directions of arrows A and B, a velocity higher than could be imparted by manually sliding the member 14 along the stick. The weight and construction of the apparatus 10 can be varied according to range desired for the toy 16 and to whether the apparatus is intended for small children — in which case the apparatus may be made relatively light weight to limit range of the toy and facilitate usage — or for older children or adults — in which case the apparatus may be made large and heavier for added range of the toy.

Although there has been described above a specific arrangement of an aerial toy and launching appartus in accordance with the invention for the purpose of illustrating the manner in which the invention may be used to advantage, it will be appreciated that the invention is not limited thereto. Accordingly, any and all modifications, variations or equivalent arrangement which may occur to those skilled in the art should be considered to be within the scope of the invention as defined in the appended claims.

What is claimed is:

1. An aerial toy and launching apparatus which comprises:

a. an elongate toy launching stick having a gripping end and an opposite toy launching end, said stick being formed with at least major portions adjacent the launching end having a generally uniform cross section and including means defining a generally helical guide about the periphery of the stick along said major portions, b. a stop disposed at the launching end of the stick and fixed relative thereto, said stop having portions projecting radially outwardly beyond adjacent surfaces of the stick, c. a sliding member of generally tubular configuration and having inner dimensions slightly larger than outer dimensions of said major portions of the stick, for permitting sliding therealong, and less than those of the radially projecting portions of the stop, for preventing the member from sliding therepast, said sliding member including guide following means on inner portions thereof for constraining the member to follow said helical guide and for thereby causing the member to rotate about the stick when the member is slid along the major portions thereof, d. an aerial toy which includes means defining a generally centrally positioned aperture for permitting the toy to be installed over the sliding member, said aperture being larger than the radially projecting portions of the stop to permit the toy to pass thereby, and e. mounting means for releasably mounting the toy to the sliding member in a manner causing the toy to move in unison when the member is slid along the major portions of the stick and for then releasing the toy from the sliding member, to cause launching thereof from the stick, in response to the sliding member being abruptly stopped by said stop at the launching end of the stick.

2. The apparatus according to claim 1, wherein the mounting means includes a thin, narrow elastomeric flange formed at an outer end region of the sliding member, said flange being at least slightly larger than the aperture of the toy, said flange being operative for deflecting to permit the toy to be released from the member when the member is abruptly stopped by the stop.

3. The apparatus according to claim 2, wherein the mounting means further includes a tubular hub formed around the aperture of said toy, said hub having wide inner walls for maintaining the toy generally orthogonal to the sliding member.

4. The apparatus according to claim 2, wherein the mounting means includes a second thin, narrow elastomeric flange formed at an inner end region of the sliding member, said second flange being at least slightly larger than the aperture of the toy, said second flange being operative for deflecting to permit the toy to be slid onto the sliding member.

5. The apparatus according to claim 1, wherein the stop includes an outwardly expanded end portion of the launching stick.

6. The apparatus according to claim 1, wherein the cross section of the major portions of the stick is generally circular in shape, wherein the helical guide includes a narrow helical flange formed outwardly from an outer surface of said major portions, and wherein the guide following means includes means defining a recess on inner walls of the toy aperture, said recess being configured to mate with said helical flange.

7. The apparatus according to claim 1, wherein the toy comprises a generally thin circular thin circular disc having outer dimensions substantially larger than that of the aperture formed therein.

8. The apparatus according to claim 7, wherein outer regions of the disc are formed downwardly and inwardly to impart a generally air foil-like cross section to the disc.

9. The apparatus according to claim 1, wherein the sliding member is comparatively short in an axial direction, being particularly adapted for being slid outwardly along the major portion of the stick solely in response to a whipping or snapping movement of the stick by a user grippng the stick at the gripping end.

* * * * *